United States Patent [19]

McDonald

[11] 3,988,981

[45] Nov. 2, 1976

[54] MANUALLY OPERATED PRESS

[76] Inventor: Charles Douglas McDonald, 2522 Butler, Dallas, Tex. 75235

[22] Filed: Jan. 23, 1976

[21] Appl. No.: 651,627

[52] U.S. Cl. ..... 100/99; 100/93 P; 100/211; 100/229 R; 100/231; 100/292; 100/257; 156/583

[51] Int. Cl.[2] ..... B30B 1/04; B30B 15/34

[58] Field of Search ..... 100/93 P, 99, 257, 229 R, 100/211, 292, 231; 156/580, 583; 34/143; 219/243

[56] References Cited

UNITED STATES PATENTS

| | | | |
|---|---|---|---|
| 154,286 | 8/1874 | Selden | 100/292 |
| 336,564 | 2/1886 | Griffin | 100/257 |
| 374,748 | 12/1887 | Netter et al. | 100/292 X |
| 1,665,403 | 4/1928 | Caps | 100/257 |
| 2,643,699 | 6/1953 | Krueger | 219/243 X |
| 2,644,151 | 6/1953 | Krueger | 100/93 P |
| 2,799,949 | 7/1957 | Richman | 219/243 X |
| 3,450,031 | 6/1969 | Peterson | 100/93 P |

*Primary Examiner*—Billy J. Wilhite
*Attorney, Agent, or Firm*—C. Douglas McDonald

[57] ABSTRACT

A manually operated press comprising a base, a movable platen opposed to the base and a frame attached to the base and carrying a movable platen includes a novel platen supporting and actuating structure which provides for adjustment of the pressure to be exerted by the press upon an object placed between the base and the platen and for adjustment to compensate for the thickness of the object to be placed between the platen and the base.

7 Claims, 7 Drawing Figures

FIG. 3A
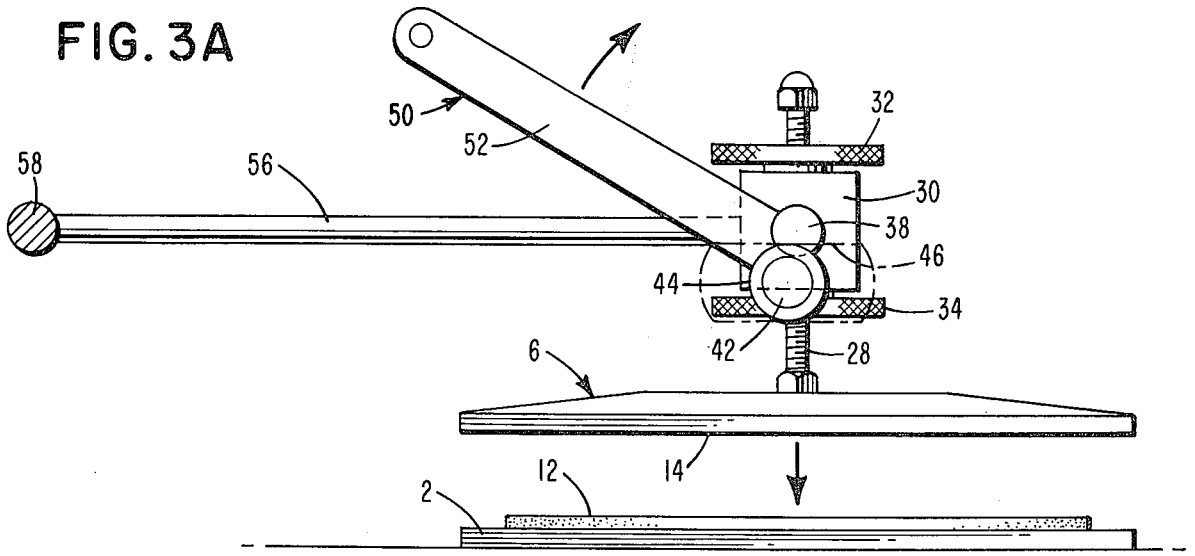
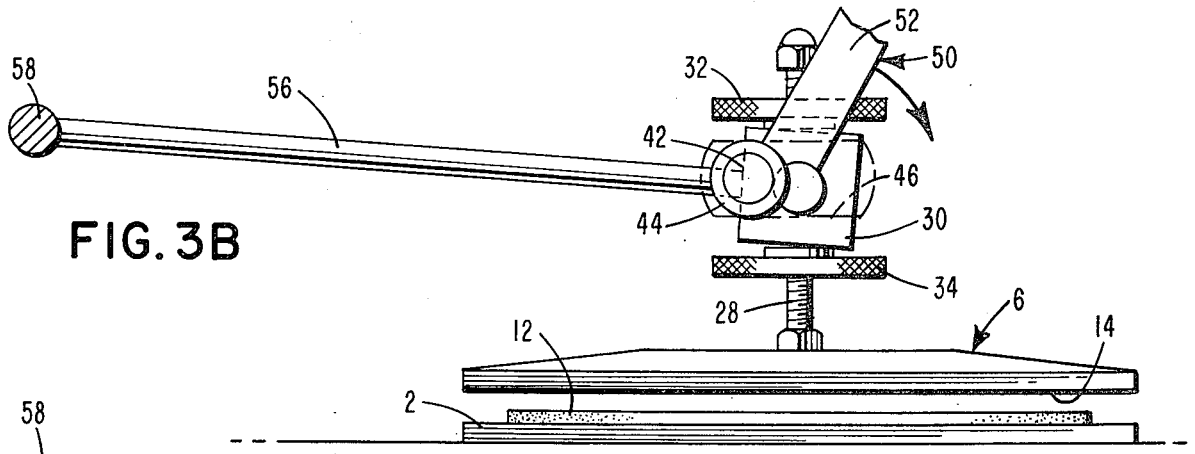
FIG. 3B
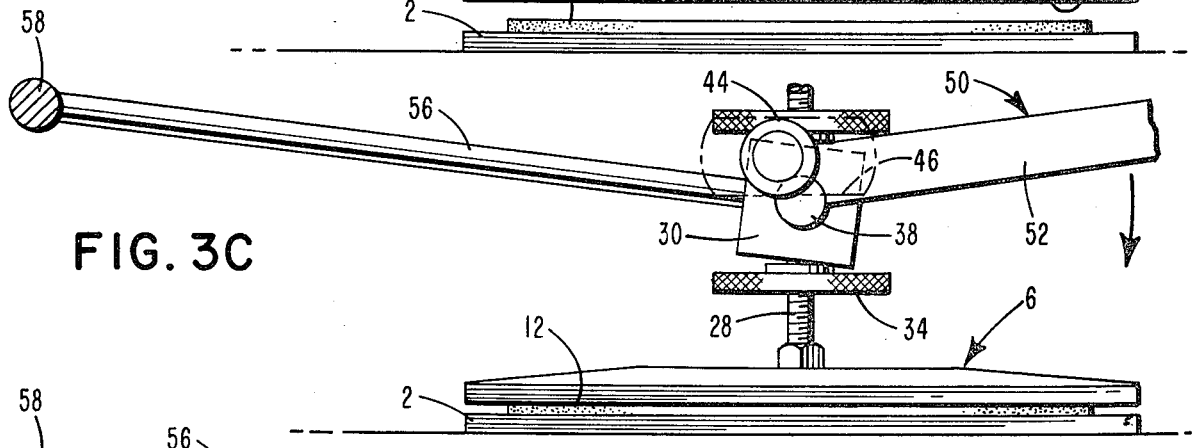
FIG. 3C
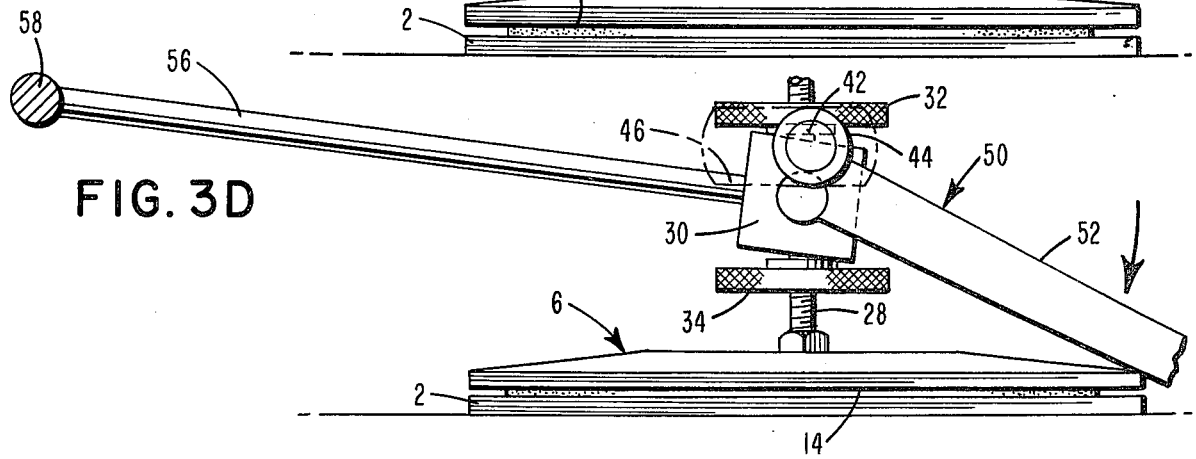
FIG. 3D

MANUALLY OPERATED PRESS

BACKGROUND OF THE INVENTION

Various types of manually operated presses have long been known in the art and have provided for more or less satisfactory operation. Many of these presses are used for photographic processing and other applications where heat and pressure are desired and have included electrical heating elements and generally are operated by some form of toggle mechanism. While this structure has generally proved rugged and reliable, it has lacked the capability of providing for a readily adjustable predetermined force to be exerted against objects of varying thicknesses placed between the platen and the base of the presses. On the other hand, presses which have provided for such adjustable predetermined forces frequently have been complex and expensive to manufacture, as well as difficult to adjust.

SUMMARY OF THE INVENTION

It is an object of this invention to provide a manually operated press which is rugged yet simple to manufacture and operate. It is a further object of this invention to provide a simple, yet reliable, structure for actuating the platen of the press toward and away from the press base, which incorporates means for compensating for varying thicknesses of objects to be pressed. It is another object of this invention to provide, in such a press, means for exerting a predetermined force against an object to be pressed, regardless of the thickness of that object.

Briefly, the invention contemplates a press, including a base, a platen generally opposed to and acting against the base and a frame attached to the base and carrying means for supporting and actuating the platen toward and away from the base. The platen supporting and actuating means includes a pressure bar extending transversely of the press and spaced above the platen, at least one platen support member joining the platen and pressure bar and at least one radius arm extending longitudinally of the press from the pressure bar to an articulated attachment on the frame such that movement of the pressure bar describes a generally arcuate path defined by the radius arm. The pressure bar actuating means joining the pressure bar and the frame includes, for each end of the pressure bar, a first shaft journaled for rotation in the pressure bar and extending outwardly of an end portion thereof, a second shaft affixed to the first shaft, adjacent and parallel thereto, and journaled within an elongated slot in the press frame for rotation about its own axis and for movement transversely of its axis and longitudinally of the press frame, and an actuating handle affixed to and extending generally radially outwardly of at least one of the shafts. By means of this structure selective arcuate movement of the handle serves to rotate the shafts in their respective journals with each first shaft, and the pressure bar journaled thereto, rotating about its respective second shaft and each second shaft rotating and moving within its respective slot, thus providing for movement of the platen selectively toward or away from the base to exert and release pressure between the base and the platen, the radii of the first and second shafts defining the maximum travel of the platen toward and away from the base. A simplified arrangement for adjusting the pressure to be exerted by the press and for compensating for varying thicknesses of objects to be pressed is also disclosed.

BRIEF DESCRIPTION OF THE DRAWINGS

The invention having been generally described, a specific embodiment will be discussed in detail with reference to the accompanying drawings in which:

FIGS. 3A–3D are schematic representations of the press of FIG. 1, illustrating the movement of the platen with respect to the movement of the actuating handle.

DESCRIPTION OF A PREFERRED EMBODIMENT

Figure 1:
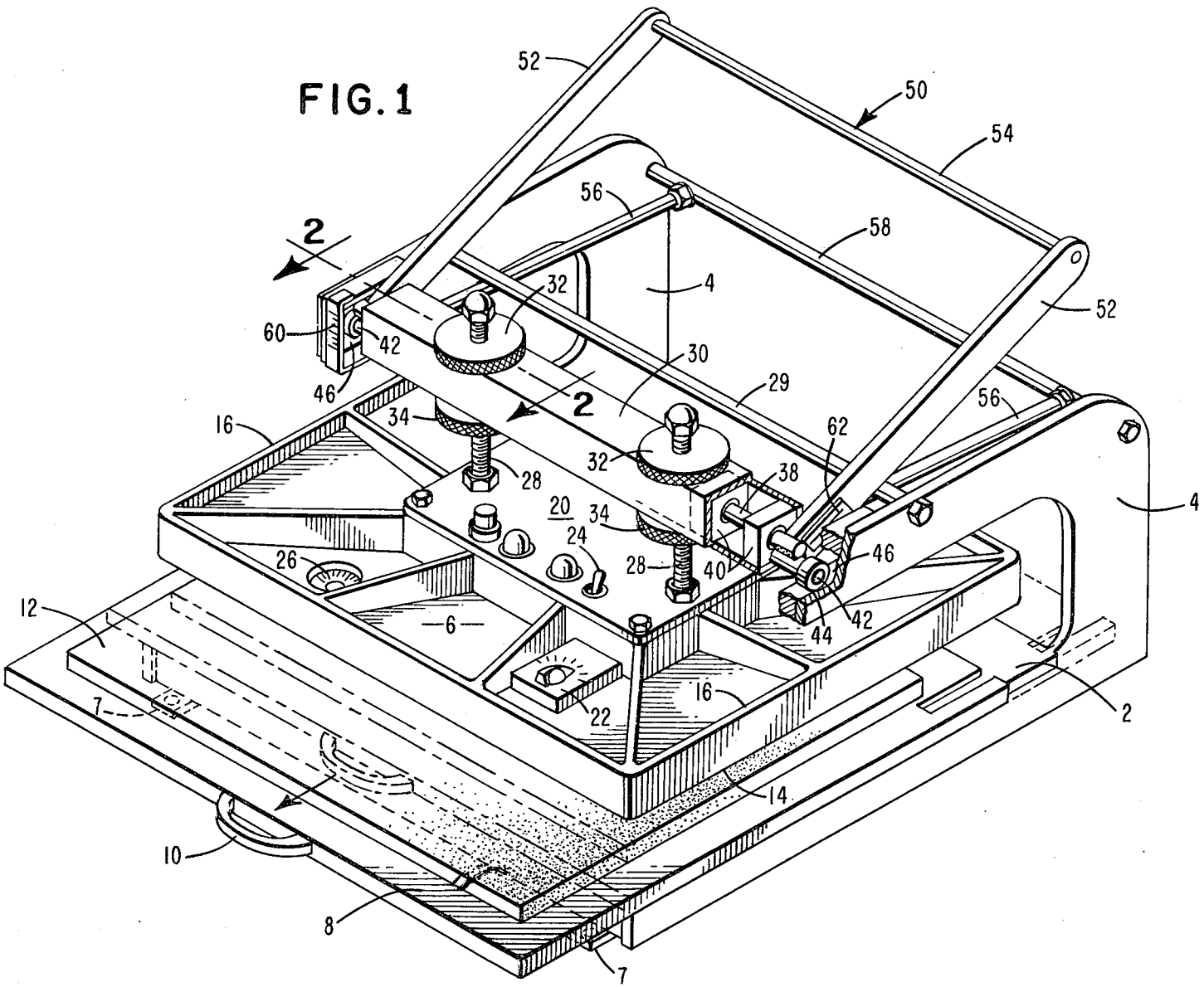
FIG. 1 is an upper front perspective view, partially in section, of the press of this invention.

One embodiment of the press of this invention is illustrated in FIG. 1. The press includes, basically, a base plate 2 attached to frame members 4, and a platen 6 opposed to the base plate 2 and supported by frame members 4 for actuation toward and away from the base plate 2.

The base plate 2 may suitably comprise a steel plate, and may be reinforced or supported against deflection if desired. Mounting feet 7 may be provided for attaching the press to a surface such as the top of a work bench. A work tray 8 may be slidably mounted to the base plate 2 such that, when the press is open, the tray 8 may be pulled out, as indicated by the arrow and the solid line representation, to facilitate placement of the work upon the working surface. Subsequently, the tray 8 may be slid to its rearmost position, as indicated by the broken line representation, to place the work directly under the platen 6 for operation of the press. Conveniently, such a tray may be fabricated of sheet metal with the edges formed around the outside edges of the base plate 2 to facilitate the slidable operation.

A compressively elastic pad 12 of neoprene or other suitable material is placed upon the work tray 8, and thus the base 2, for purposes to be described below. The platen 6 of this embodiment is illustrated as being a ribbed, reinforced casting having a broad flat surface 14 facing the base 2 and having a raised lip 16 extending around the periphery of the platen. A plurality of reinforcing ribs extend between this lip 16 and a box-like center section 20 to reinforce the platen against deflection when pressure is applied. The platen 6 is further illustrated as including heating apparatus such that both pressure and heat may be applied to the work. This heating apparatus may include a heating coil (not illustrated) located within the platen structure and controlled by a temperature control 22 and switch 24. Conveniently, a temperature measuring device 26 may be inset into the platen to indicate the temperature being applied to the work.

The platen 6 is connected to the frame members 4 through at least one and preferably a pair of platen support members 28, which are adjustably mounted on pressure bar 30. Pressure bar 30, in turn, is mounted at each end to the frame members 4 by pressure bar actuating assemblies. The upper portions of frame members 4 are supported against outward deflection by tie rod 29.

Figure 2:
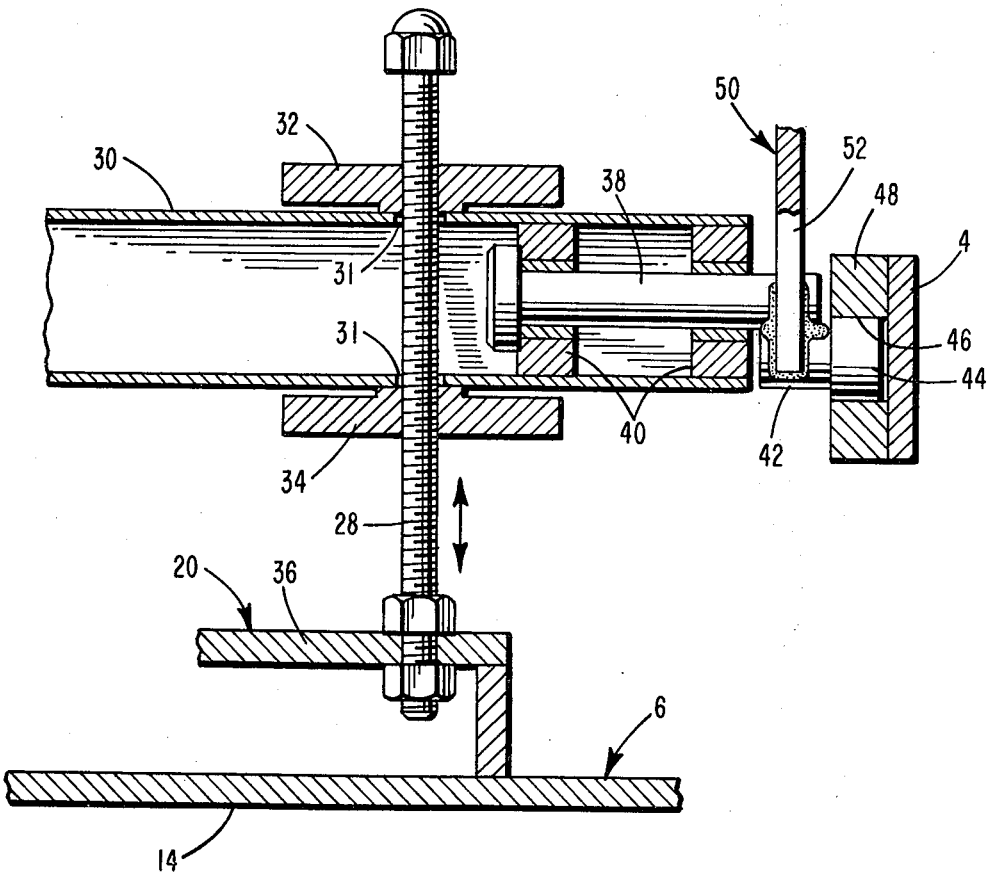
FIG. 2 is a section taken along line 2—2 of FIG. 1.

The platen supporting structure and pressure bar actuating assemblies are shown in the partial section of FIG. 1 and more clearly in the sectional view of FIG. 2. The pressure bar 30 may conveniently be formed of steel tubing having a generally square cross section. The platen supporting members 28 each may suitably comprise a threaded shaft extending through oversized holes 31 in pressure bar 30 and may be longitudinally adjustable by means of upper and lower knurled adjusting nuts 32 and 34, respectively, which abut the upper and lower surfaces, respectively, of pressure bar 30. The lower end of platen support member 28 is rigidly affixed to top plate 36 of platen pressure box 20, suitably by a lock nut arrangement as illustrated. Thus, platen 6 is rigidly attached to pressure bar 30 in a manner providing for vertical adjustment between the platen 6 and the pressure bar 30, as indicated by the arrows in FIG. 2.

Each end of the pressure bar 30 is joined to its respectively adjacent frame member 4 as illustrated in FIG. 2. Specifically, at each end a first shaft 38 is journaled for rotation in a pair of bearing blocks 40 internally affixed to pressure bar 30. These first shafts 38 project outwardly of each end of the pressure bar 30 and are affixed, suitably by welding, to immediately adjacent and parallel second shafts 42. Each of these shafts 42 carries at its outer end a bearing 44, preferably a ball or roller bearing, which is journaled within a generally horizontally elongated slot 46 in a portion of its respective frame member 4. The elongated slot 46, which may be seen more clearly in the schematic representation of FIGS. 3A–3D, has a vertical height only slightly greater than the outside diameter of bearing 44 and has a substantially greater length, such that second shaft 42 may rotate about its own axis within bearing 44 and may move transversely of its axis, longitudinally of the press frame within the slot 46. The slot 46 conveniently may be provided in a portion of each frame member 4 which comprises an additional plate 48 which is welded, screwed, or otherwise rigidly affixed or made integral with each frame member 4. If desired, each slot 46 may be open-ended, formed by two parallel members spaced apart an appropriate distance and rigidly affixed to the frame member 4.

For actuation of the press to move the platen toward and away from the base an actuating handle 50 is provided. This handle 50 suitably may comprise a pair of lever arms 52 affixed, such as by welding, to at least one and preferably both of shafts 38 and 42, extending generally radially outwardly of such shaft or shafts. A connecting rod 54 rigidly connects the outer ends of the lever bars 52.

To control the direction of movement of the platen 6 toward and away from base 2, at least one, and preferably two, radius arms 56 are provided extending longitudinally of the press, each connected at one end to the pressure bar and at its opposite end to a bar 58 extending transversely of the press and pivotally attached at each end to frame members 4. Thus, by virtue of the articulated attachment to the press frame, these radius arms 56 limit the movement of the pressure bar 30, and thus the platen 6, to a generally arcuate path.

With the structure of the press described above, its manner of operation can best be seen in FIGS. 3A–3D, which illustrate the press in various stages of actuation while moving the platen 6 from its fully open position (FIG. 3A) through its descent (FIGS. 3B to 3D) to its position of closest approach to base 2 (FIG. 3D), all as controlled by actuating handle 50.

As seen in FIG. 3A, when actuating handle 50 is placed in its rearmost position (as illustrated), its attachment relative to mutually affixed shafts 38 and 42 causes shaft 38, which is concentric with pressure bar 30, to lie generally above shaft 42. By virtue of the connection between shafts 38 and 42, this places pressure bar 30, and its connected platen 6, at the maximum distance from base 2 and compressively elastic pad 12.

FIG. 3B illustrates the result of initial movement of the handle approximately 90 degrees from the fully open position. In this illustration it can be seen that first shaft 38 is rotating about second shaft 42. Since the vertical position of second shaft 42 is fixed by its journaling (through its bearing) within elongated slot 46, the movement of shaft 38 from a position above shaft 42 to a position along side shaft 42, as in FIG. 3B, results in a lowering of pressure bar 30 and thus of platen 6. Radius arm 56, mounted to the press frame through pivotal connection 58, limits the movement of pressure bar 30 to a generally arcuate path and prevents any substantial longitudinal displacement of the pressure bar. Accordingly, it is necessary that second shaft 42 and its bearing 44 be allowed to move longitudinally of slot 46, moving rearwardly in FIG. 3B to permit movement of shaft 38 forwardly of shaft 42. Bearing 44 may be preferably a roller bearing rolling against the sides of slot 46 or may be a plain bushing sliding against the sides of said slot.

FIG. 3C represents continued movement of actuating arm 50, and its concomitant rotation of first shaft 38 about shaft 42, to a position in which the lower surface 14 of platen 6 just contacts compressively elastic pad 12 and any object placed on top of that pad. It may be noted that, by virtue of the fixed arc of movement described by pressure bar 30 and radius arm 56, this continued movement of actuating arm 50 causes second shaft 42 and its bearing 44 to begin moving forwardly in the slot 46.

Continued movement of the handle 50 in the direction of the arrow beyond the position illustrated in FIG. 3C will serve to compress the resilient pad 12 and thus exert force upon any object interposed between pad 12 and the lower surface 14 of platen 6. FIG. 3D illustrates movement of the handle to its lowermost position in which shaft 38, in its rotation about second shaft 42, is moved just to or very slightly past bottom dead center of shaft 42. At this point, the lever arms 52 forming part of the actuating handle 50 abut the edge of the platen 6, preventing any further downward movement of the handle and thus arresting the movement of the platen. Thus, it can be seen that the radii of shafts 38 and 42 define the maximum travel of the platen 6 toward and away from the base 2. Obviously, reverse movement of actuating handle 50 reverses the rotation of shaft 38 about shaft 42 and opens the press.

Since it is desired to be able both to exert different predetermined pressures upon objects placed between the base and platen of the press, and also to accommodate conveniently objects of different thicknesses, adjustments are provided on the press for these purposes. The spacing between the platen and the base, with the press both open and closed, may be adjusted by threading knurled adjusting nuts 32 and 34 upwardly and downwardly along platen supporting members 28, thus raising or lowering the platen 6 with respect to the pressure arm 30. By means of this platen location adjustment and the compressively elastic pad 12 interposed between the platen 6 and the base 2 (and between the work object and the base 2), the pressure to be exerted upon a work object may be adjusted. The compressively elastic pad 12, of any convenient thickness such as three-eighths inch, is selected for its compressibility characteristics. Suitably, the material may be a cellular synthetic resin, such as neoprene, possessing the characteristics defined by the standard ASTM-D-1056-62T, class RO12. This material, suitably having a density of approximately 20 lbs/ft$^3$, has a compressibility defined by an included angle of 25 degrees when a 5 to 9 pound force is exerted by a 1.129 inch diameter standardized disc. While this material has been found to be highly suitable, numerous other similar materials having similar or different compressibility characteristics may be utilized, depending upon the force to be exerted by the press. With such a compressively elastic pad, the amount of force exerted by the platen against an object interposed between the platen and the compressively elastic pad, which rests upon the press base, is determined by the distance of compression of such pad by the lowering of the platen between the point of initiation of compression and the point of closest approach of the platen 6 to base 2. Thus, in order to exert a preselected force upon an object, regardless of its thickness, it is desirable to preselect the distance of compression of the compressively elastic pad 12 when the platen is brought to its full descent and is at its point of closest approach to the base. As is apparent, the distance of descent of the platen will always be the same for a given movement of the actuating handle from one preselected position to a second preselected position, and the force exerted by the platen against a work object will always be the same for a given distance of compression of the compressively elastic pad 12. Accordingly, the provision of means for selectively adjusting, and preselecting, the distance that the pad is to be compressed by the full descent of the platen provides for repeatable exertion of a preselected force against an object, regardless of its thickness. This means for adjusting the compression distance is provided by a pair of calibrated scales 60 at the outer end of the upper portion of each frame member 4 acting in cooperation with indicators 62 on the outwardly facing surfaces of each of the handle lever arms 52.

Figure 4:
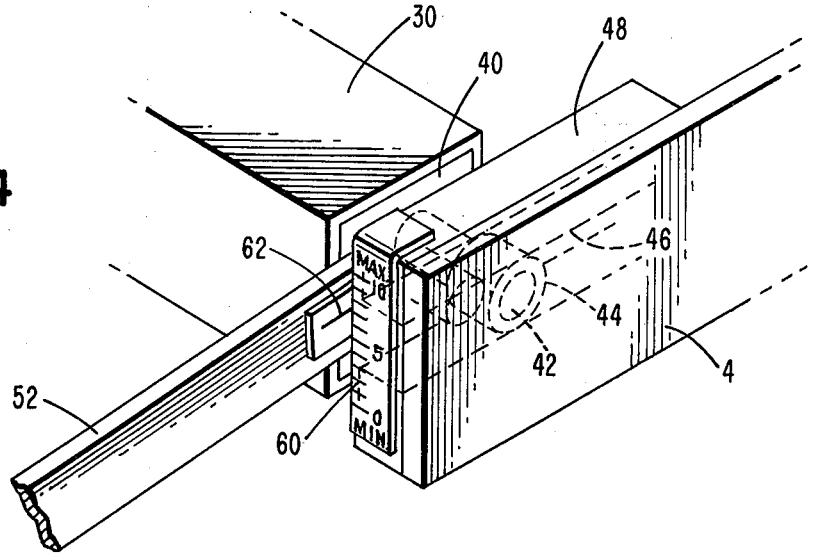
FIG. 4 is a fragmentary perspective view of the press of this invention with the actuating handle and platen in the positions illustrated in FIG. 3C.

This compression distance adjusting means is illustrated in FIG. 4, in which the platen 6 and actuating handle 50 are in the positions illustrated in previously described FIG. 3C. With this arrangement, when it is desired to obtain a preselected force against a work object upon the full descent of the platen, the object is placed upon the compressively elastic pad 12 and the lower knurled adjusting nuts 34 are threaded downwardly away from the pressure bar 30. Then, the actuating handle is swung forward until the platen rests of its own weight upon the work object. Next, the upper adjusting nuts 32 are threaded upwardly out of contact with pressure bar 30 in order that the position of the handle 50, with the indicators affixed thereupon, may be adjusted without moving the platen 6. At that point the position of actuating handle 50 is adjusted such that the indicator 62 on either of the handle lever arms 52 is moved into alignment with the desired force calibration mark on its respective calibration scale 60. The handle 50 is then held in that position momentarily while the lower adjusting nuts 34 are threaded up the platen support members 28 to engage the lower surface of pressure bar 30. With the pressure bar 30 thus supported by lower adjusting nuts 34, the upper adjusting nuts 32 may then be threaded down the platen support members 28 to engage the upper surface of pressure bar 30. Thereafter, continued downward movement of the actuating handle 50 by an operator will advance the platen 6 toward the base 2 a predetermined distance before the movement is arrested by engagement of the handle 50 with the platen 6, thus effecting the compression of compressively elastic pad 12 a predetermined distance. Accordingly, this preselected distance of compression of such pad 12, which has a predetermined elasticity, will effect the exertion of a predetermined force upon the work object in a press that is both simple to operate and economical to build.

While the foregoing represents a preferred embodiment of this invention, it is to be considered as illustrative only of the principles of the invention. Further, since numerous modifications and changes within the scope of this invention will readily occur to those skilled in the art, the invention is not to be limited to the exact construction and operation shown and described but is to encompass all suitable modifications and equivalents falling within the scope of the invention. Accordingly, this invention is to be limited not by the foregoing description but solely by the claims appended hereto.

What is claimed is:

1. A press including a base, a platen generally opposed to and acting against said base, and a frame attached to said base and carrying means for supporting and actuating said platen toward and away from said base, said platen supporting and actuating means comprising in combination:

a pressure bar extending transversely of said press and spaced above said platen;

at least one platen support member joining said platen and said pressure bar;

at least one radius arm extending longitudinally of said press from said pressure bar to an articulated attachment to said frame, whereby movement of said pressure bar describes a generally arcuate path defined by the radius arm; and pressure bar actuating means joining said pressure bar to said frame and comprising for each end of said pressure bar a first shaft journaled for rotation in said pressure bar and extending outwardly of an end portion thereof, a second shaft affixed to said first shaft, adjacent and parallel thereto, and journaled within a horizontally elongated slot in said press frame for rotation about its own axis and for movement transversely of its axis and longitudinally of said press frame, and an actuating handle affixed to and extending generally radially outwardly of at least one of said shafts, whereby selective arcuate movement of said handle serves to rotate said shafts in their respective journals with each first shaft and the pressure bar journaled thereto rotating about its respective second shaft and each second shaft rotating and moving within its respective slot, thus causing movement of the platen selectively toward or away from the base to exert and release pressure between the base and the platen, the radii of the first and second shafts defining the maximum travel of the platen toward and away from the base.

2. A press according to claim 1 further comprising means for selectively adjusting the force to be exerted by said press against an object interposed between said platen and said base, said force adjusting means comprising:

a compressively elastic pad of predetermined elasticity interposed between said base and said platen, whereby force exerted against the pad by the platen and any object interposed therebetween serves to compress the pad, with a predetermined distance of compression effecting a predetermined force exerted between the pad and the platen and on any object interposed therebetween; and means for selectively adjusting the distance said pad is to be compressed by the full descent of said platen against said pad and any object interposed therebetween.

3. A press according to claim 2 wherein said compression distance adjusting means comprises:

means for selectively adjusting the length of said platen support member between said platen and said pressure bar whereby the vertical spacing between the platen and the base at the point of their closest approach may be adjusted, and means for selecting the point of rotation of said first shaft about said second shaft at which said platen initiates compression of said pad during descent of said platen, whereby only a preselected distance of descent of the platen is available for compression of the pad between the point of initiation of compression and the point of closest approach of the platen.

4. A press according to claim 3 wherein said rotation point selecting means comprises the combination of a calibrated scale associated with said press frame and a calibraton indicator affixed to said pressure bar actuating handle.

5. A press according to claim 1 further comprising means for arresting the movement of said handle in one direction and releasably holding the position of said handle and said pressure bar when the axis of said first shaft is disposed generally vertically below the axis of said second shaft, whereby the movement of the platen is correspondingly stopped and held generally at the point of closest approach of the platen to the base.

6. A press according to claim 1 further comprising a pair of said platen support members.

7. A press according to claim 1 further comprising a pair of said radius arms.

* * * * *